United States Patent [19]

Wilson

[11] Patent Number: 4,651,989

[45] Date of Patent: Mar. 24, 1987

[54] FLAG FOOTBALL DEVICE AND COUPLING THEREFOR

[75] Inventor: Portor C. Wilson, Tucson, Ariz.

[73] Assignee: Flag-A-Tag, Inc., Tucson, Ariz.

[21] Appl. No.: 756,133

[22] Filed: Jul. 17, 1985

[51] Int. Cl.[4] ..... A44B 21/00

[52] U.S. Cl. ..... 273/55 C; 2/321; 2/322; D2/629

[58] Field of Search ..... 273/55 C; D2/414; 24/584, 643, 647, 585; 2/316, 317, 319, 321, 322, 336

[56] References Cited

U.S. PATENT DOCUMENTS

| | | | |
|---|---|---|---|
| D. 276,477 | 11/1984 | Kanzaka | D2/414 |
| 311,104 | 1/1885 | Colton | 24/585 |
| 3,345,070 | 10/1967 | Wilson et al. | 273/55 C |
| 3,498,610 | 3/1970 | Foley | 273/55 C |
| 3,579,745 | 3/1969 | Wilson | 273/55 C |

FOREIGN PATENT DOCUMENTS

| | | | |
|---|---|---|---|
| 143977 | 7/1935 | Austria | 24/585 |

*Primary Examiner*—Richard C. Pinkham
*Assistant Examiner*—T. Brown
*Attorney, Agent, or Firm*—Millen & White

[57] ABSTRACT

In a flag tag game device, there is provided a coupling for detachable coupling of a flag to a belt. The coupling includes a first member of flexible cup-shaped structure having a greater inside wall to inside wall distance adjacent the interior base than adjacent the opening thereof. A correspondingly shaped member is provided for being secured in the first member by suction. A belt having an adjustable buckle is also provided to which the coupling is attached. The buckle of the belt is adjustable in two manners. The first is gross adjustment and the second is fine adjustment so that the belt can be worn by users of all ages.

12 Claims, 9 Drawing Figures

FLAG FOOTBALL DEVICE AND COUPLING THEREFOR

CROSS-REFERENCE TO RELATED PATENTS

This application is related to U.S. Pat. Nos. 2,966.356, 3,251,109, 3,279,745 and 4,304,403 of the same inventor. The disclosures of these patents are specifically incorporated by references herein.

BACKGROUND OF THE INVENTION

This invention relates to a novel flag-tag device and to an improved coupling and an improved belt buckle for such a device.

Games utilizing "chase-catch" instincts are as old as civilization. One of the most elaborate and complicated is the game of football as played in the United States of America. Rules in the game provide fair and equal opportunities to win, and along with the demands of strategy and physical skills, combine to make football the United States' favorite sport. Unfortunately, this great game has been mostly a "spectator" sport.

The reason for this is that the playing of tackle football requires much heavy body contact as well as extensive falling or rolling contact with the ground. Thus, the tackle version of the game of football requires much physical conditioning and expensive safety equipment. These are factors which make mass participation in this version of the game impossible.

An alternative version has been played which requires stopping of the ball carrier by a two handed "tag" or "touch", and this, in combination with modified blocking rules has allowed less restricted participation in the game. However, this game becomes less exciting because the ease with which the "touch" or "tag" is made prevents the ball carrier from going forward into or through a group of opponents.

Still another alternative involves stopping the ball player by removing a tail, streamer or flag from the body. However, these flags, in order to make the game exciting, must detach only after use of the same approach as in making a good tackle in the "tackle" version of the game.

The ideal is to provide a set of flag devices which spin, spiral and flutter so as to be elusive, and which ideally requires a pull-away tension of 15–20 lbs. The flags should require an "along-side" approach with a center flag grasp and clean jerk-away to accomplish deflagging. If these standards are required, this will make the game exciting and will make it available for safe mass participation of people of both sexes and all ages. As noted before, such devices are generally illustrated by the above-identified patents of the same inventor.

In prior art flag type games, a flag has typically been attached to the belt or other waist-encircling arrangement of a wearer by releasable coupling parts in a manner such that the flag is pulled away from its attachments to the belt by a predetermined pull-away tension to the belt. This serves to detach the flag coupling part from the cooperative belt coupling part. Normally, these coupling parts have been designed as cooperating ball and socket devices, as shown in U.S. Pat. Nos. 2,966,356; 3,251,109; 3,345,070; and 3,579,745. Such coupling parts are typically formed of plastic material and it has been found that where resiliency of the socket part is relied upon for the attachment and release of the ball part, the resiliency varies under different conditions of climate and particularly in colder climates, where the socket part may shrink to such a degree that the pull-away force to separate the coupling part becomes excessive, this creates substantial problems in using the device.

By enlarging the socket or female part as compensation, other problems are created and results in non-uniform performance of the coupling in varied climates.

Bifurcating the ball does not fully solve the problem and reduces the durability of the ball.

In a more recent improvement in this type of device, as evidenced by the device of U.S. Pat. No. 4,304,403, a ball member is provided with an open-ended through slot to provide resiliency to the cheeks of the ball to permit manual attachment and detachment thereof relative to the socket member. An attachment member is positioned by an angled portion extending outwardly of the belt of a player to secure the end of a game flag or similar game piece thereto.

Although providing an improvement over the above-discussed prior art devices, it has been found that even this type of ball and socket coupling assembly will wear out as a result of time and although the problems with respect to changes in climate are somewhat ameliorated, the same problem still exists, but on a lesser scale. Furthermore, even with this type of device, should it be functioning properly, it has also been found that a disadvantage of use thereof is that many times in the excitement of the game the person wearing the device and having the flag detached therefrom will not notice the tug, and continue playing thereby delaying the game unnecessarily.

In other prior flag-tag games, another problem has been that the belts in use generally need to be constructed of several different sizes. First sizes for smaller players with smaller waists who would not be able to wear larger sizes for use by adult-type players. A second size is used for adult-type players which when used on smaller players would result in a dangling extension of the belt which is often mistaken for a flag and pulled upon to down the player.

One belt design which attempts to correct this problems is disclosed in U.S. Pat. No. 3,355,744 and describes a belt and engaging member onto which the excess belt amount can be looped to prevent the belt end from flopping during the games. However, it is often the case that the user will forget to engage the belt in said element, thereby defeating the purpose of this provision.

SUMMARY OF THE INVENTION

It is thus an object of this invention to provide equipment for flag football and comparable games that enables set standard tension separation, of the flags from a player, while at the same time ensuring secure coupling on a repetitive basis.

It is another object to provide a safe plastic flexible belt buckle or fastener that is economical to manufacture, and which further, can be used effectively by players of all sizes. The buckle can be used with wide or thin belting whose color can be easily seen over the entire playing area. The buckle provides for automatically securing excess loose running and belting unexposed inside the buckle. Thus, players can no longer forget to secure loose ends of the belting.

It is still another object of the invention or provide a combination flag football and comparable game apparatus that includes the above-discussed improved coupling as well as the safe plastic flexible belt buckle or fastener with the belt buckle or fastener providing for both gross and fine adjustment of the length of the belt. Accordingly, automatic and instantaneous adjustment to all waist sizes is incorporated into this design.

Still further, another object is the reduction in the use of unnecessary equipment by providing identifying markings on the equipment.

Yet still another object is to provide a device of the type described having an enlarged buckle face whereupon exchangeable turn and lock display receptacles can be placed. A variety of precut shapes and color inserts can thus be displayed allowing a team to choose a variety of decal identity displays including those of potential commercial team sponsors.

Upon further study of the specification and appended claims, further objects and advantages of this invention will become apparent to those skilled in the art.

In one aspect, the invention is an improvement in a flag-tag game device having a support member for attachment thereof to the belt of a player, and a game piece detachable from the support member at a coupling. The coupling (flag to belt) is constructed to use atmospheric pressure and friction to attain the above-discussed 15–20 lbs. break-away tension. In addition, the device is designed to produce a loud "pop" noise on detachment which improves the game for spectators or officials by providing instant proof of deflagging. The components are made of soft resilient wear resistant plastic to reduce wear from repeated insertions and detachments.

The pull away of the flag is of a nature which automatically imposes a correct "tackle" type approach. A firm grasp and clean jerk away is required. The device relies on vacuum holding force such that interior vacuum will reseat the connection members if there is any pause in disengagement and if the pull-away is slow.

The improvement in the one aspect is directed to the coupling which comprises a first element fixedly attached to the support member and comprises a flexible cup-shaped structure having a greater inside wall-to-inside wall dimension adjacent the interior base of the cup-shaped structure than the wall-to-wall dimension adjacent the opening thereof. A second element adapted for detachably coupling with the cup-shaped member is also provided. This second element corresponds at its exterior to the shape of the first element to fit sufficiently tightly therein to create a suction-generated force holding the second element inside the first element. Thereby, forces tending to pull the first and second elements apart are resisted.

In a more specific aspect, the amount of suction generated can be controlled and further, when separated, the elements generate a "popping" noise which signals when the elements have separated, facilitating the playing of the game.

In another aspect, the improvement is directed to the buckle, which comprises a first buckle member shaped for having the belt selectively wrapped around a predetermined number of times to provide gross adjustment of the belt length. Furthermore, means are provided for securing the end of the belt to the first buckle member, and the first buckle member also includes a plurality of notches extending along the lower edge or the upper edge thereof for being engaged by a notch engaging means on a second buckle member to provide fine belt length adjustment relative to the gross adjustment.

The second buckle member is constructed for slidably receiving the first buckle member and is attachable to the other end of the belt. The second buckle member has the notch engaging means movable between a first engaging position for engaging one of the plurality of notches of the first buckle member in and out of the second buckle member.

In still another more specific aspect of the invention, the improvement is directed to the combination in a flag-type game equipment kit of the above-discussed buckle and coupling.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DISCUSSION OF THE INVENTION

Figure 1:
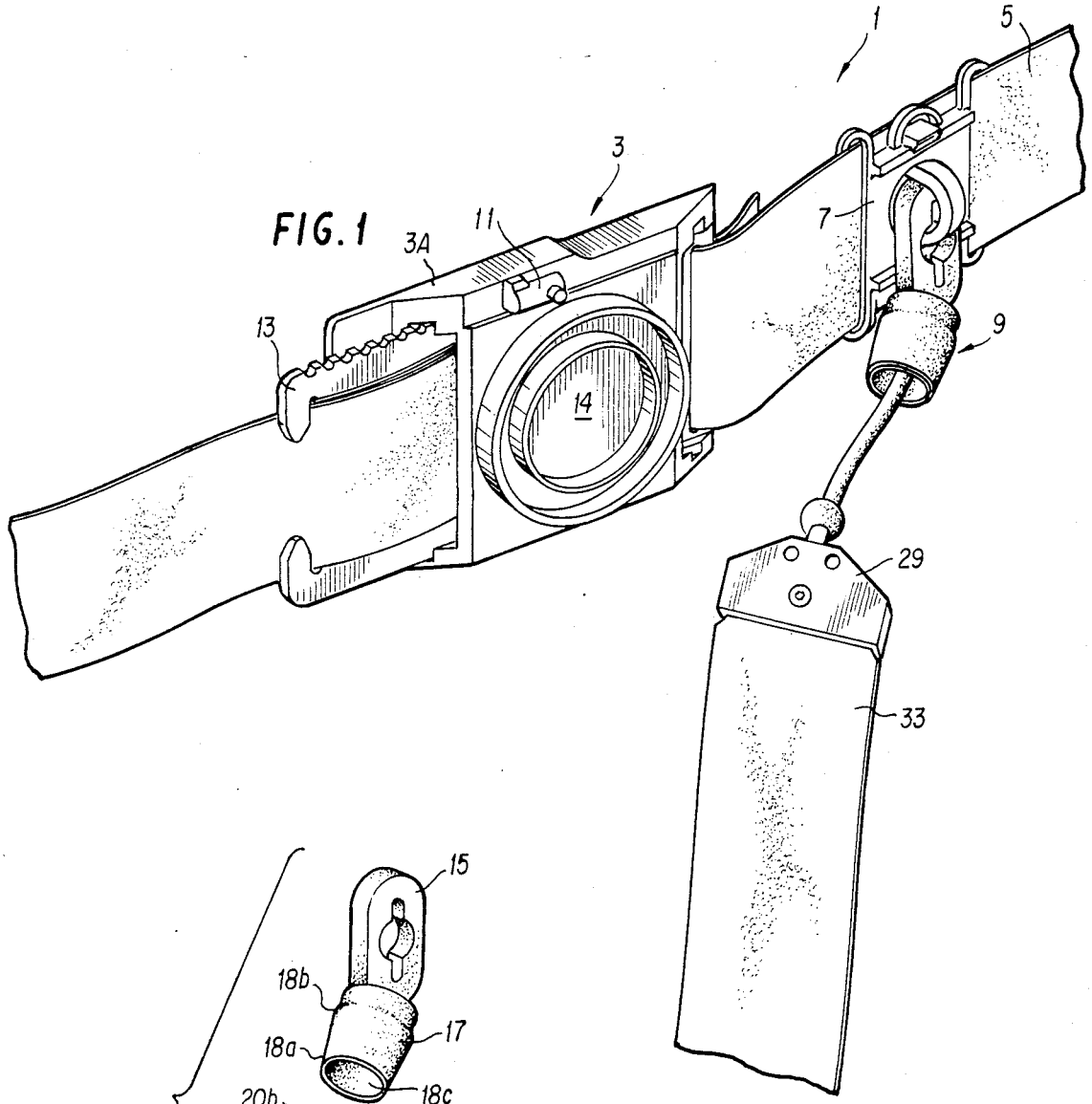
FIG. 1 is a perspective view, in part, of the combination belt buckle and coupling of the invention shown in coupled position.

In all figures, like reference numerals designate like elements.

In FIG. 1 there is shown the combination belt, belt buckle and coupling device in accordance with the invention. The belt buckle 3 is shown and includes, in addition to a receiving member 3A, a member 13 to be slidably received therein and engaged therewith by a notch engaging knob 11. The receiving member 3A includes space in the form of a detachable element to be described hereinafter, for providing indicia 14 as desired on the face thereof to provide appropriate identifying markers. On the belt 5 there is shown a support slide 7 which is slidable on the belt to be positioned at any predetermined position as desired and for supporting the coupling 9 of the invention. The slide belt support is of the type disclosed in U.S. Pat. No. 4,304,403 whose entire disclosure is specifically incorporated by reference herein.

Figure 2:
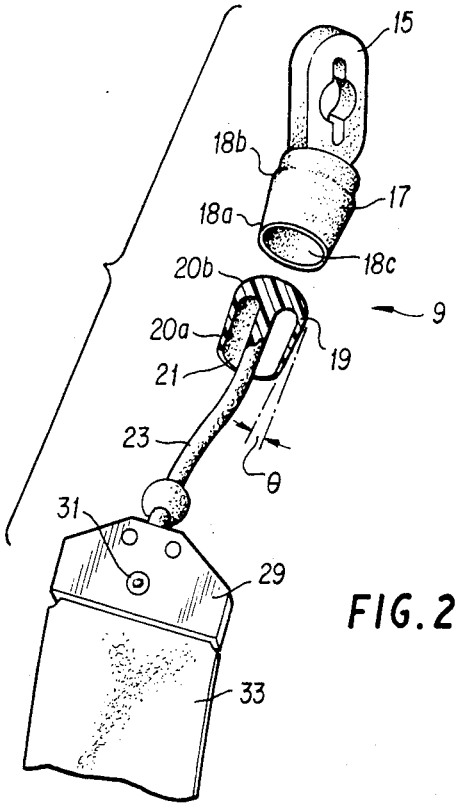
FIG. 2 is an exploded view of the coupling with flag in side view in accordance with the invention.

As shown in greater detail in FIG. 2, in exploded view, the coupling 9 includes a belt attachable support 15 having an elongated aperture into which either the belt can be inserted, or through which an engaging member attached to the belt can be inserted to support a female cup-shaped member 17 of the coupling. The female cup-shaped member 17 of the coupling includes an opening 18*c* in the interior thereof adapted for receiving a correspondingly shaped male member 19. The interior of the female cup-shaped member 17 is larger in the region 18*b* away from the opening thereof, and narrower in the region 18*a*, closest to the opening thereof. The belt-attached support is typically made preferably of a substantially rigid plastic material with the female coupling member 17 being also of a plastics type material, but being supple and flexible by nature. A preferred material for use which is highly resistant to wear from repeated use is commercially available from Monsanto Rubber-like plastic; shore 87–90A hardness and flexibility. Other conventional materials of this type will also serve the purpose as will become more readily apparent to those of ordinary skill in the art.

In addition, the correspondingly shaped male member 19 is provided for being received within the female member 17. The male member includes a larger diameter portion 20*b* for fitting in the larger diameter portion 18*b* of the female member 17 as well as a lesser diameter portion 20*a* for fitting in the lesser diameter portion 18*a* of the female member 17. By providing such an inwardly tapering structure, which taper with respect to a vertical line is preferably at an angle 0 of about 1°, as shown in FIG. 2, a suction is created when the male member 19 is inserted in the female member 17 whereupon separating the two members a "popping" sound is created. By correspondingly shaping the members in a known manner, the generated suction force resisting withdrawal of the male member 19 from the female member 17 can be adjusted in a manner known to those of ordinary skill in the art. It should be noted in this regard that the material making up the the male member is also a plastics type material, preferably flexible in the same manner as the portion which is flexible in the female member 17.

Figure 3A:
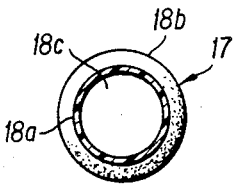
FIG. 3 is a cross-sectional view from the bottom of the first cup-shaped member of the coupling of the invention.
FIG. 3B is a cross-sectional view from the bottom of the second coupling member of the device according to the invention.
Figure 3B:
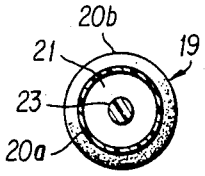

As connected to a flag in a flag-type football game, the male member 19 will be hollow on the inside 21 and include a reinforced portion at the upper end thereof from which there projects a stem 23 downwardly to be coupled by a ball and socket to the flag-holding element 29 with the flag 33 being attached thereto by means of bolts or other like securing devices 31. The flag attachment is of the type disclosed in U.S. Pat. No. 4,304,403 which is already incorporated by reference herein. The structure of the male and female coupling members is better illustrated in the cross-sectional view of FIGS. 3A and 3B whereby the upwardly expanding diameter is more clearly illustrated by viewing these figures.

In a preferred embodiment, the flag game combination will include two flags at predetermined positions on the belt on either side of the player's body. To secure these flags onto the belt there is provided a special slide support element 7 and although as is clearly obvious from viewing the slot in the member 15 of the coupling that the belt can be slid through the slot thereof, it is preferred that the support 7 be employed in combination with the belt. The support element 7 has a loop projecting therefrom which passes through a hole in the member 15 so that the flag swings freely on the belt of player. The construction of this device is old and is of the type shown in U.S. Pat. No. 3,579,745 which disclosure is incorporated specifically by reference herein.

Figure 4B:
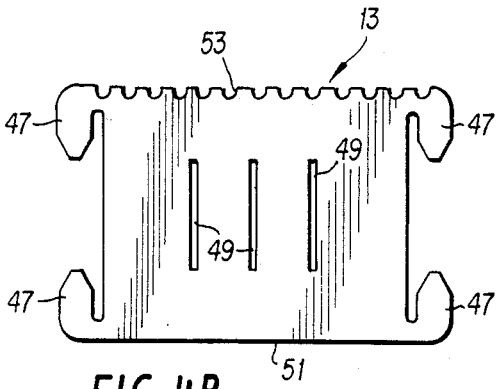
FIG. 4B is a front view of the first buckle member providing for gross adjustment and having the notches thereon for being finely adjusted when slidably received in the second buckle member of FIG. 4A.
Figure 4A:
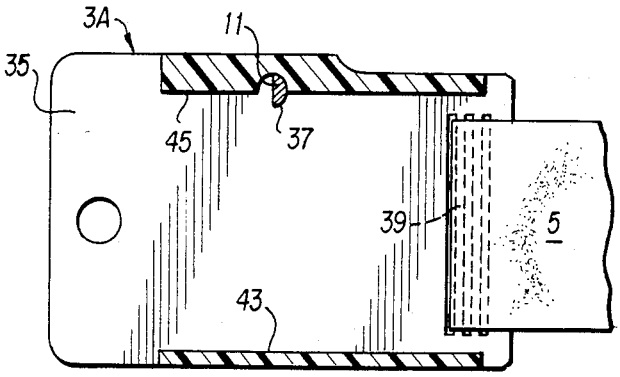
FIG. 4A is a partly broken-away view from the front of the second buckle member of the device according to the invention.
Figure 4C:
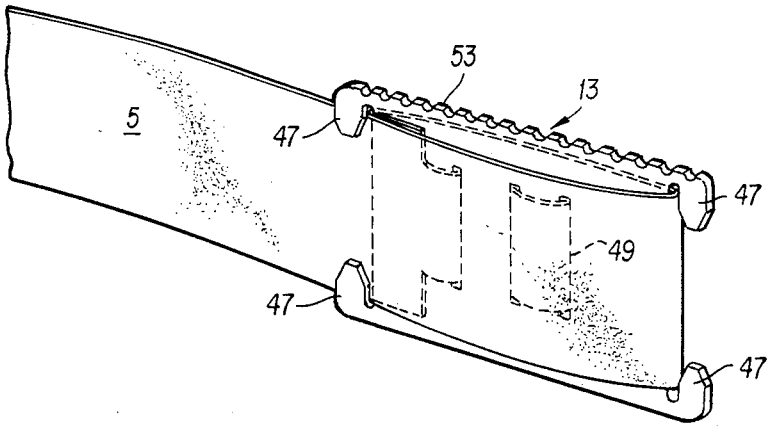
FIG. 4C shows the buckle member of FIG. 4B with the belt wrapped therearound for gross adjustment and showing, in dashed lines, the end of the belt secured thereto.

With respect to the belt buckle, a first element 13 is shown in FIG. 4B which provides for gross adjustment of the belt length and slides into a second element 3A which includes a fine adjustment engaging mechanism 11, including a notch engaging projection 37. In use, the end of the belt is attached to the engaging slots 49 of FIG. 4B by being woven therethrough as shown in FIG. 4C in dashed lines. Thereafter, to provide gross adjustment, the belt is wrapped around the device and engaged by projections 47 to be held firmly around the device and engaged by projections 47 to be held firmly around the device. The other end of the belt is attached to rods 39 of buckle element 3A so that when it is desired to buckle the belt closed, element 13 is then slid with lower edge 51 engaging the bottom of a sliding recess 43 in the buckle element 3A and the upper notched edge 53 sliding into the upper recess 45 of the buckle element. In the illustrated embodiment, upper notched edge 53 slides in the upper recess 45 of buckle element 3A; however, the buckle element can of course be turned upside down so that the edge 53 is on the bottom as in the recess 45. In this case, the notch engaging means will be in the non-operative rotated position and when the precise adjustment for the belt length has been reached for the wearer, the notch engaging element 11 is rotated so that the notch engaging means 37 thereof engages the appropriate notch on the notched edge 53 of the belt.

Figure 5A:
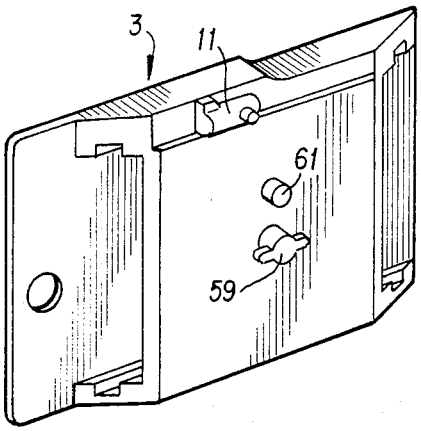
FIGS. 5A and 5B show in schematic diagram the belt buckle and the separable decal or sticker holder in accordance with the invention.
Figure 5B:
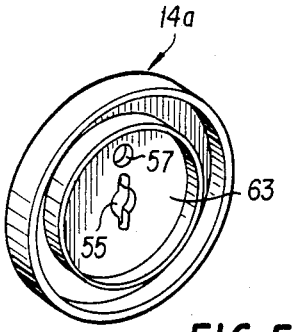

In FIGS. 5A and 5B the buckle 3 is shown with a detachable decal or sticker holding element 14*a*. As can be seen, the element 14*a* is secured onto buckle 3 by an engaging and turning motion into a locked position by engagement of openings 55 and 57 with projections 59 and 61, respectively of buckle 3. The recessed portion 63 serves to hold decals or which can be in turn covered by a transparent member held over the decals or stickers in the recessed portion.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a flag tag game device having a support member for attachment thereof to the belt of a player and a game piece detachable from the support member at a coupling, the improvement wherein said coupling comprises a first element fixedly attached to the support member and comprising a flexible cup-shaped structure having a closed base and a wall with a smooth interior surface and a greater inside wall-to-wall dimension adjacent the interior base of the cup-shaped structure than inside wall-to-wall dimension adjacent the opening thereof, and a second element with a flag attachment thereto adapted for detachably coupling with said cup-shaped member, at least one of said first and second elements being resilient, said second element corresponding in shape to said first element to fit sufficiently tightly therein and having a relatively stiff head portion and relatively flexible side wall means of a thickness less than that of the head portion, the side wall portions frictionally engaging the smooth interior surface of the cup-shaped structure to create a suction generated force holding said second element inside said first element resisting forces tending to pull said first and second elements apart, whereby detaching the second element from the first element results in the emission of an abrupt audible signal generally referred to as a "pop".

2. A flag tag game device as in claim 1 further comprising the flag being fixedly secured to said second element by a flexible stem to facilitate pulling said first and second elements apart.

3. A flag tag game as in claim 2 wherein said second element has a stem extending thereform to which is secured said flag by means of a ball and socket coupling.

4. A flag tag game as in claim 1 wherein said first and second elements are made of flexible, resilient plastic material.

5. The flag tag game of claim 1 wherein the first element has an attachement with a hole therethrough and the belt has a loop which passes through the hole so that the first element is attached to the belt and swings freely.

6. In a flag tag game device having a support member for attachment thereof to the belt of a player and a game piece detachable from the support member at a coupling, and said belt having a buckle for being buckled onto a user, the improvement wherein said buckle comprises a first buckle member shaped for having said belt selectively wrapped around a predetermined number of times to provide gross adjsutment of the belt length, and having means for securing the end of the belt thereto, and having a plurality of notches extending along the lower edge or the upper edge thereof for being engaged by a notch engaging means to provide fine belt length adjustment relative to said gross adjustment; a second buckle member constructed for slidably receiving said first buckle member therein, and having notch engaging means movable between a first engaging position for engaging one of said plurality of notches at a predetermined adjustment setting an a second non-engaging position; and wherein said coupling comprises a first element fixedly attached to the support member and comprising a flexible cup-shaped structure having a base and a wall with a smooth interior surface and a greater insde wall-to-wall dimension adjacent the base of the cup-shaped structure than the inside wall-to-wall dimension adjacent the opening thereof, and a second element with a flag attached thereto adapted for detachably coupling with said cup, at least one of said first and said second elements being resilient, said second element corresponding in shape to said first element to fit sufficiently tightly therein and having a relatively stiff head portion and a relatively flexible side wall of a thickness less than the head portion wherein the side wall frictionally engages the smooth interior surface of the cup-shaped structure to create a suction generated force holding said second element inside said first element resisting forces tending to pull said first and second elements apart, whereby detachment of the second element from the first element results in an abrupt audible signal generally referred to as a "pop".

7. A flag tag game device as in claim 6 further comprising the flag being fixedly secured to said second element by a flexible stem to facilitate pulling said first and second elements apart.

8. A flag tag game as in claim 7 wherein said second element has a stem extending therefrom to which is secured said flag by means of a ball and socket coupling.

9. A flag tag game as in claim 6 wherein said first and second elements are made of flexible, resilient plastic material.

10. A flag tag game device as in claim 6 wherein said buckle further comprises a releasably locking member having a region for displaying information therein when worn by a user.

11. The apparatus of claim 10 wherein the region for displaying information is defined by at least one circular wall raised from the surface of the buckle within which wall a display member is retained.

12. The flag tag game of claim 6 wherein the first element has an attachment with a hole therethrough and the belt has a loop which passes through the hole so that the first element is attached to the belt and swings freely with respect to the belt.

* * * * *